US007612740B2

(12) United States Patent
Kim et al.

(10) Patent No.: US 7,612,740 B2
(45) Date of Patent: Nov. 3, 2009

(54) PLASMA DISPLAY AND DRIVING METHOD THEREOF

(75) Inventors: Jin-Sung Kim, Suwon-si (KR); Tae-Seong Kim, Suwon-si (KR); Jin-Ho Yang, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 671 days.

(21) Appl. No.: 11/267,208

(22) Filed: Nov. 7, 2005

(65) Prior Publication Data

US 2006/0055636 A1 Mar. 16, 2006

(30) Foreign Application Priority Data

Nov. 5, 2004 (KR) ..... 10-2004-0089750

(51) Int. Cl.
*G09G 3/28* (2006.01)

(52) U.S. Cl. ..... 345/63; 345/60; 345/66; 345/68; 345/67; 315/169.4; 315/169.3; 315/169.1; 315/66

(58) Field of Classification Search ..... 345/60–72; 315/169.1–169.4

See application file for complete search history.

(56) References Cited

U.S. PATENT DOCUMENTS

| | | | | |
|---|---|---|---|---|
| 6,219,013 | B1 | 4/2001 | Amano | |
| 6,294,875 | B1 * | 9/2001 | Kurata et al. | 315/169.1 |
| 6,414,658 | B1 | 7/2002 | Tokunaga | |
| 6,456,265 | B1 | 9/2002 | Mikoshiba et al. | |
| 6,483,251 | B2 | 11/2002 | Setoguchi et al. | |
| 6,512,501 | B1 * | 1/2003 | Nagaoka et al. | 345/66 |
| 7,339,553 | B2 | 3/2008 | Nagao et al. | |
| 7,468,713 | B2 | 12/2008 | Ogawa et al. | |
| 7,508,359 | B2 | 3/2009 | Han | |
| 2004/0155836 | A1 * | 8/2004 | Kim et al. | 345/60 |
| 2004/0160392 | A1 * | 8/2004 | Kim et al. | 345/63 |
| 2004/0251830 | A1 | 12/2004 | Nagano et al. | |
| 2005/0162351 | A1 | 7/2005 | Kim | |

FOREIGN PATENT DOCUMENTS

| | | |
|---|---|---|
| CN | 1 242 857 A | 1/2000 |
| CN | 1 355 518 A | 6/2002 |
| CN | 1 614 665 | 5/2005 |
| CN | 1 614 668 A | 5/2005 |

(Continued)

*Primary Examiner*—Richard Hjerpe
*Assistant Examiner*—Ishara T Perumpulliarachchige
(74) *Attorney, Agent, or Firm*—Lee & Morse, P.C.

(57) ABSTRACT

A plasma display device includes a plasma display panel having discharge cells formed between a plurality of first electrodes and a plurality of second electrodes and a driving circuit dividing one frame into a plurality of subfields, each subfield including a reset period, an address period, and a sustain period, and applying a driving voltage to the first electrodes and the second electrodes. During a sustain period of each subfield, a sustain discharge pulse is alternately applied to the first and second electrodes for triggering a sustain discharge. A width of a last sustain discharge pulse applied to the second electrode is set to be greater than a width of other sustain discharge pulses for selected subfields. The subfields may be selected based on whether a total number of the sustain discharge pulses during the sustain period is less than a critical number of sustain discharge pulses.

19 Claims, 3 Drawing Sheets

FOREIGN PATENT DOCUMENTS

| | | | |
|---|---|---|---|
| EP | 0 903 719 | A2 | 3/1999 |
| EP | 0 903 719 | A3 | 3/1999 |
| EP | 1 020 838 | | 7/2000 |
| EP | 1530193 | A2 * | 5/2005 |
| JP | 2000-259120 | A | 9/2000 |
| JP | 2000-267627 | | 9/2000 |
| JP | 2002-014652 | | 1/2002 |
| JP | 2002-116730 | A | 4/2002 |
| JP | 2003-005700 | A | 1/2003 |
| JP | 2003-015596 | A | 1/2003 |
| JP | 2003-066899 | A | 3/2003 |
| JP | 2003-122294 | | 4/2003 |
| JP | 2003-263127 | A | 9/2003 |
| JP | 2004-198776 | A | 7/2004 |
| JP | 2004-198777 | A | 7/2004 |
| JP | 2004-206094 | A | 7/2004 |
| JP | 2004-271877 | A | 9/2004 |
| JP | 2004-302480 | A | 10/2004 |
| KR | 10-2004-0007708 | | 1/2004 |

* cited by examiner

PLASMA DISPLAY AND DRIVING METHOD THEREOF

BACKGROUND OF THE INVENTION

1. Field of the Invention

The present invention relates to a plasma display and a method for driving the same.

2. Description of the Related Art

A plasma display device is a flat display device that uses plasma generated by gas discharge to display characters or images. Depending on its size, the plasma display device has more than several scores to millions of discharge cells arranged in a matrix pattern.

A plasma display panel of the plasma display device includes a substrate having sustain and scan electrodes formed thereon, and another substrate having address electrodes formed perpendicularly across the scan and sustain electrodes. In addition, the sustain electrodes are formed in respective correspondence to the scan electrodes, and ends of the sustain electrodes are connected in common.

One frame of the plasma display device is divided into a plurality of subfields. Each subfield includes a reset period, an address period, and a sustain period. The reset period is for erasing wall charges formed by a previous sustain discharge and setting up wall charges so that the next addressing can be stably performed. The address period is for selecting turn-on/turn-off cells, i.e., cells to be turned on or off, in the panel and accumulating wall charges in the turn-on cells, i.e., addressed cells. The sustain period is for causing a sustain discharge for displaying an image on the addressed cells.

During the address period, a scan pulse and an address pulse are applied to a scan electrode (hereinafter, referred to as a "Y electrode") and an address electrode (hereinafter referred to as an "A electrode"), respectively for selecting turn-on cells between the Y and A electrodes. However, generation of a discharge triggered by a voltage applied between the Y and A electrodes is delayed from when the voltage is applied therebetween. Particularly, since the address discharge is expected to be generated within the width of constant scan and address pulses, a discharge may be not generated when a discharge delay is greater than the width of the scan and address pulses.

The above information disclosed in this Background section is only for enhancement of understanding of the background of the invention, and therefore it may contain information that does not constitute prior art.

SUMMARY OF THE INVENTION

The present invention is therefore directed to a plasma display device and a method for driving the same, which substantially overcome one or more of the problems due to the limitations and disadvantages of the related art.

It is a feature of an embodiment of the present invention to provide a plasma display device and a method for driving the same having a reduced address discharge delay to facilitate a stable addressing operation.

It is another feature of an embodiment of the present invention to provide a plasma display device and a method for driving the same having a width of a last sustain discharge pulse applied to a sustain electrode in a sustain period to be greater than a width of other sustain discharge pulses.

It is yet another feature of an embodiment of the present invention to provide a plasma display device and a method for driving the same having a width of a last sustain discharge pulse applied to a sustain electrode in a sustain period to be greater than a width of other sustain discharge pulses for selected subfields, e.g., a first subfield.

At least one of the above and other features and advantages may be realized by providing a method for driving a plasma display device having a plurality of first electrodes and a plurality of second electrodes, one frame for driving the plasma display device being divided into a plurality of subfields, each subfield including a reset period, an address period, and a sustain period, the method including, during a sustain period of a first subfield among the plurality of subfields, alternately applying a plurality of sustain discharge pulses to the first electrode and the second electrode for triggering a sustain discharge and setting a width of a last sustain discharge pulse applied to the second electrode to be greater than a width of other sustain discharge pulses.

A total number of the sustain discharge pulses applied during the sustain period of the first subfield may be less than a critical number of sustain discharge pulses SDPc, e.g., fifteen. The width of the last sustain discharge pulse applied to the second electrode may be greater than 1.5 μs, and may be greater than 3 μs.

The width of the last sustain discharge pulse applied to the second electrode may be equal to the width of the other sustain discharge pulses during a sustain period of a subsequent subfield among the plurality of subfields. The first electrode may be a scan electrode and the second electrode may be a sustain electrode.

A last sustain discharge pulse of the sustain period of the first subfield may be applied to the first electrode. During a reset period immediately following the sustain period of the first subfield, a voltage of the first electrode may be gradually decreased from a high-level voltage applied to the first electrode during the sustain period of the first subfield.

At least one of the above and other features and advantages may be realized by providing a plasma display device, including a plasma display panel having discharge cells formed between a plurality of first electrodes and a plurality of second electrodes and a driving circuit dividing one frame into a plurality of subfields, each subfield including a reset period, an address period, and a sustain period, and applying a driving voltage to the first electrodes and the second electrodes, wherein the driving circuit, during a sustain period of each subfield, alternately applies a sustain discharge pulse to the first electrode and the second electrode for triggering a sustain discharge, and setting a width of a last sustain discharge pulse applied to the second electrode to be greater than a width of other sustain discharge pulses for selected subfields.

For selected subfields, the last sustain discharge pulse applied to the sustain electrode may be greater than 1.5 μs, and may be greater than 3 μs. The driving circuit may select subfields based on whether a total number of the sustain discharge pulses applied to the sustain period is less than a critical number of sustain discharge pulses SDPc, e.g., fifteen. The first electrode may be a scan electrode and the second electrode may be a sustain electrode.

In a reset period immediately following the sustain period, the driving circuit may initialize discharge cells that have experienced a sustain discharge in the sustain period. The last sustain discharge pulse during the sustain period may be applied to the first electrode.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1:
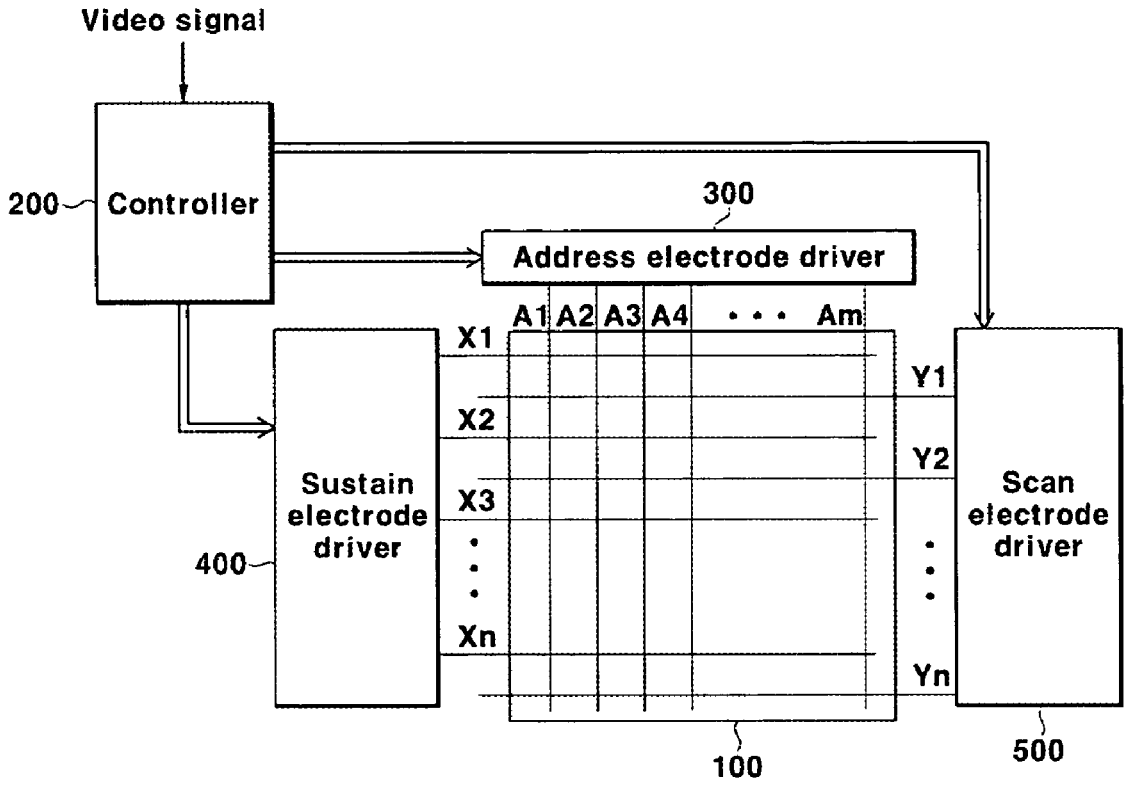
FIG. 1 illustrates a schematic diagram of a plasma display device according to an embodiment of the present invention.

Korean Patent Application No. 10-2004-0089750 filed in the Korean Intellectual Property Office on Nov. 5, 2004, and entitled: "Plasma Display Device and Driving Method Thereof," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions are exaggerated for clarity of illustration. Like reference numerals refer to like elements throughout.

FIG. 1 illustrates a schematic view of a plasma display device according to an exemplary embodiment of the present invention. As shown in FIG. 1, the plasma display device includes a plasma display panel (PDP) 100, a controller 200, an address electrode driver 300, a sustain electrode driver 400 and a scan electrode driver 500.

The PDP 100 includes a plurality of address electrode A1-Am extended in a column direction, and a plurality of scan electrodes Y1-Yn and a plurality of sustain electrode X1-Xn in pairs extended in a row direction. Respective sustain electrodes X1-Xn correspond to respective scan electrodes Y1-Yn, and ends of these two electrodes are connected in common. The PDP 100 includes a substrate (not shown) on which the sustain electrodes X1-Xn and the scan electrodes Y1-Yn are arranged, and a substrate (not shown) on which the address electrodes A1-Am are arranged. The two substrates are arranged to face each other with discharge spaces therebetween so that the scan electrodes Y1-Yn and the sustain electrodes X1-Xn may respectively cross the address electrodes A1-Am. In this instance, discharge spaces at crossing regions of the address electrodes A1-Am and the sustain and scan electrodes X1-Xn and Y1-Yn form discharge cells. FIG. 1 shows an exemplary structure of the PDP 100, while the PDP 100 may have a different configuration to which the following driving waveform can be applied.

The controller 200 receives an external video signal and outputs an address electrode driving control signal, a sustain electrode driving control signal and a scan electrode driving control signal. The controller 200 divides one frame into a plurality of subfields. Each subfield includes a reset period, an address period and a sustain period according to time-based operational changes.

The address electrode driver 300 receives the address electrode driving control signal from the controller 200 and applies a display data signal to the respective address electrodes for selecting a turn-on cell.

The sustain electrode driver 400 receives the sustain electrode driving control signal from the controller 200 and applies a driving voltage to the sustain electrodes X.

The scan electrode driver 500 receives the scan electrode driving control signal from the controller 200 and applies a driving voltage to the scan electrodes Y.

Figure 2:
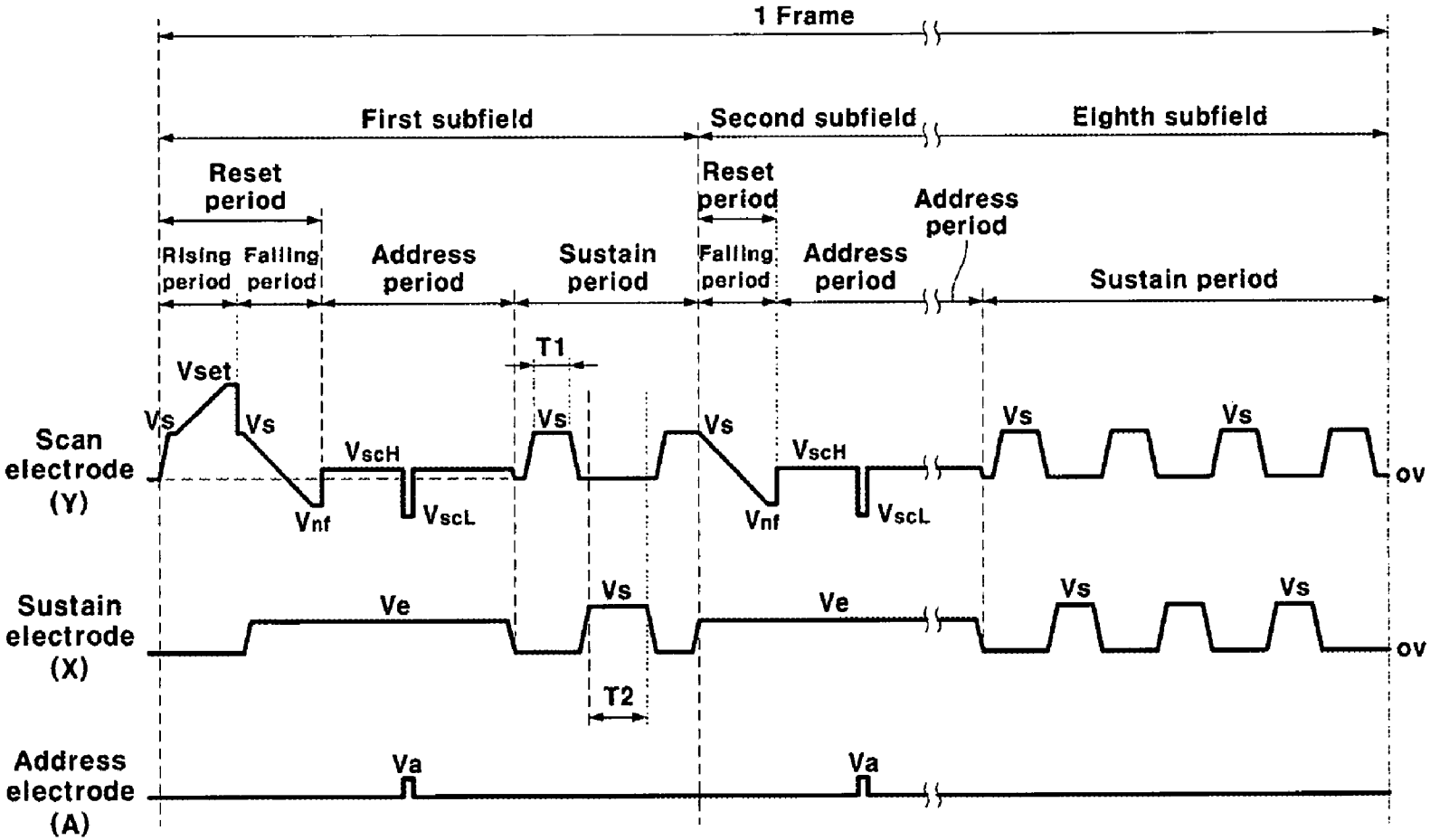
FIG. 2 illustrates a driving waveform of a plasma display device according to an embodiment of the present invention.

FIG. 2 illustrates driving waveforms applied to the address electrodes A1-Am, the sustain electrodes X1-Xn, and the scan electrodes Y1-Yn, respectively, in each subfield. A discharge cell described in the following description is formed in a discharge space at crossing regions of an address electrode, a sustain electrode and a scan electrode. As used herein, "wall charge" means charges formed on a wall, e.g., a dielectric layer, close to each electrode of a discharge cell and accumulated on the electrodes. The wall charge will be described as being "formed" or "accumulated" on the electrode even though the wall charges do not actually touch the electrode. Further, as used herein, "wall voltage" means a potential difference formed on the wall of the discharge cell by the wall charge.

FIG. 2 is a driving waveform diagram of a plasma display panel according to an exemplary embodiment of the present invention. In FIG. 2, one frame is divided into eight subfields: a first subfield to an eighth subfield. As shown in FIG. 2, each subfield includes a reset period, an address period and a sustain period. A reset period of the first subfield includes a rising period and a falling period, and reset periods of the second to the eighth subfields include a falling period. Herein, a reset period having rising and falling periods is defined as a "main reset period," and a reset period having a falling period only is defined as an "auxiliary reset period."

During the rising period of the reset period in the first subfield, a voltage of the scan electrode Y increases from a voltage Vs to a voltage Vset while maintaining the sustain electrode X at 0V. While the voltage of the scan electrode Y increases, a weak discharge occurs between the scan and address electrodes Y and A and between the scan and sustain electrodes Y and X. Accordingly, negative (−) wall charges are formed on the scan electrode Y, and positive (+) wall charges are formed on the address and sustain electrodes A and X.

During the falling period of the reset period in the first subfield, the voltage of the scan electrode Y decreases from the voltage Vs to a voltage Vnf while maintaining the sustain electrode X at a voltage of Ve. While the voltage of the scan electrode Y decreases, a weak discharge occurs between the scan and sustain electrodes Y and X and between the scan and address electrodes Y and A. Accordingly, the negative (−) wall charges formed on the scan electrode Y and the positive wall charges formed on the sustain and address electrodes X and A are eliminated and discharge cells are initialized.

Subsequently, during the address period for selecting turn-on cells, a scan pulse of the voltage VscL and an address pulse of a voltage of Va are applied to scan and address electrodes Y and A of the turn-on cells, respectively. A non-selected scan electrode Y is biased at a voltage VscH that is higher than the voltage VscL, and a reference voltage is applied to the address electrode of the turn-off cells. Then an address discharge is generated on a cell due to a wall voltage generated by a difference between the voltage Va of the address electrode A and the voltage VscL of the scan electrode Y and wall charges formed on the address and scan electrodes A and Y. As a result, positive (+) wall charges are formed on the scan electrode Y and negative (−) wall charges are formed on the sustain and address electrodes X and A.

Subsequently, during the sustain period of the first subfield, a sustain discharge pulse is applied to the scan electrode Y and the sustain electrode X and, as a result, the polarities of the discharge pulse are inverted in the scan electrode Y and the sustain electrode X since the discharge pulse alternately has a high level voltage (Vs in FIG. 2) and a low level voltage (0V in FIG. 2) That is, the sustain electrode X is applied with 0V when the voltage Vs is applied to the scan electrode Y, the scan electrode Y is applied with 0V when the voltage Vs is applied to the sustain electrode X. Then, a discharge is generated between the scan electrode Y and the sustain electrode X due to the wall charge and the voltage Vs when the wall voltage is generated between the scan electrode Y and the sustain electrode X by the address discharge in the address period.

The process of applying the sustain pulses to the scan electrode Y and the sustain electrode X is repeated by a number corresponding to a weight value of a corresponding subfield.

In accordance with an exemplary embodiment of the present invention, when a sustain period of a subfield has a number of the sustain discharge pulses less than a critical number required to sufficiently generate priming particles for a particular PDP, a width T2 of a last sustain discharge pulse applied to the sustain electrode X is set to be greater than a width T1 of other sustain discharge pulses. Experimentally, insufficient generation of priming particles occurs when a subfield has less than 15 sustain discharge pulses during the sustain period. However, the number of sustain discharge pulses may be changed according to characteristics of a PDP.

When the sustain period of the first subfield ends, the second subfield starts. The reset period of the second subfield includes the falling period only, as described above.

During the reset period of the second subfield, the voltage of the scan electrode Y is gradually decreased to the voltage Vnf from the sustain discharge pulse of the voltage Vs applied in the sustain period of the first subfield.

In this instance, negative (−) wall charges are formed on the scan electrode Y and positive (+) wall charges are formed on the sustain and address electrodes X and A when the sustain discharge is generated during the sustain period of the first subfield. Accordingly, a weak discharge is generated in a like manner of the generation of the weak discharge in the falling period of the reset period in the first field while the voltage of the scan electrode Y gradually decreases. Since a final voltage Vnf of the scan electrode Y is equivalent to a final voltage Vnf of the falling period of the first subfield, a condition of the wall charge after the falling period of the second subfield ends is substantially equivalent to a condition of the wall charge after the falling period of the first subfield ends.

The wall charge condition in the cell is maintained at a condition of the end of the falling period of the first subfield because the address discharge is not generated during the address period of first subfield. No discharge is generated when the voltage of the scan electrode Y is reduced to the voltage Vnf. As a result of the applied voltage, after the falling period of the first subfield is finished, the wall voltage formed on the cell approaches the discharge firing voltage. Accordingly, such a cell maintains the wall charge conditions established in the reset period of the first subfield because no discharge is generated in the reset period of the second subfield.

As described above, when a reset period of a subfield includes a falling period only, a reset discharge is generated only when a sustain discharge is generated in a previous subfield.

The address and sustain periods of the second subfield are equivalent to the address and sustain periods of the first subfield, while the number of sustain discharge pulses during the sustain period is determined corresponding to a weight value of the second subfield. Address and sustain periods of the third to eighth subfields are equivalent to the address and sustain periods of the second subfield, excluding the number of sustain discharge pulses during the sustain period. In addition, a width of a last sustain pulse applied to a sustain electrode X, having less than 15 sustain discharge pulses among the second to eighth subfields, is set to be greater than a width of other discharge pulses.

In the following description, the width of the last sustain discharge pulse applied to the sustain electrode X during the sustain period is set to be greater than the width of other sustain discharge pulses applied to the sustain electrode during the sustain period.

As previously described, a voltage is applied between the two electrodes, and accordingly, a discharge is generated. However, the generation of the discharge is delayed from when the voltage is applied. Particularly, an address discharge is greatly affected by a discharge delay because the address discharge has to be generated within the width of the scan and address pulses. Since the generation of the address discharge is determined by wall charges formed in the discharge spaces after the reset period ends, an address discharge delay is influenced by a condition of the wall charges in an immediately previous subfield. A condition of the wall charge after the reset period ends is determined by a condition of the wall charges after the last sustain discharge in the immediately previous subfield, the address discharge delay is influenced by the condition of the wall charge of the immediately previous subfield.

In general, a sustain period, i.e., one period during which a sustain discharge pulse is applied to the respective electrodes, is typically 4-5 μs. The width T1 of the sustain discharge pulses respectively applied to the scan and sustain electrodes Y and X are both approximately 1.5 μs. When the width of the sustain pulse is consistent, wall charges generated due to the sustain discharge are accumulated as to the electrodes during a period corresponding to the width of the sustain pulse. However, an amount of priming particles are insufficiently formed in a subfield where a number of sustain discharge pulses less than a critical number for that PDP are applied and thereby resulting in inefficient generation of sustain discharges. Accordingly, relatively weak sustain discharges are generated and an inefficient amount of wall charges are accumulated to the electrodes during a period corresponding to a width of a typical sustain discharge pulse. In particular, a sufficient amount of wall charges has to be generated when the voltage Vs of the last sustain discharge pulse applied to the sustain electrode X right before the voltage Vs is applied to the scan electrode X since an auxiliary reset period starts after the voltage Vs is applied to the scan electrode X. However, an auxiliary reset operation may become unstable in a subfield where a number of sustain discharge pulses than a critical number for that PDP are applied, resulting in inefficient generation of wall charges in the sustain period, and accordingly generation of the address discharge in the next consecutive address period become also unstable.

In accordance with an exemplary embodiment of the present invention, to overcome this problem and insure sufficient wall charges, the width T2 of the last sustain discharge pulse applied to the sustain electrode X is set to be greater than the width T1 of other sustain discharge pulses.

Figure 3:
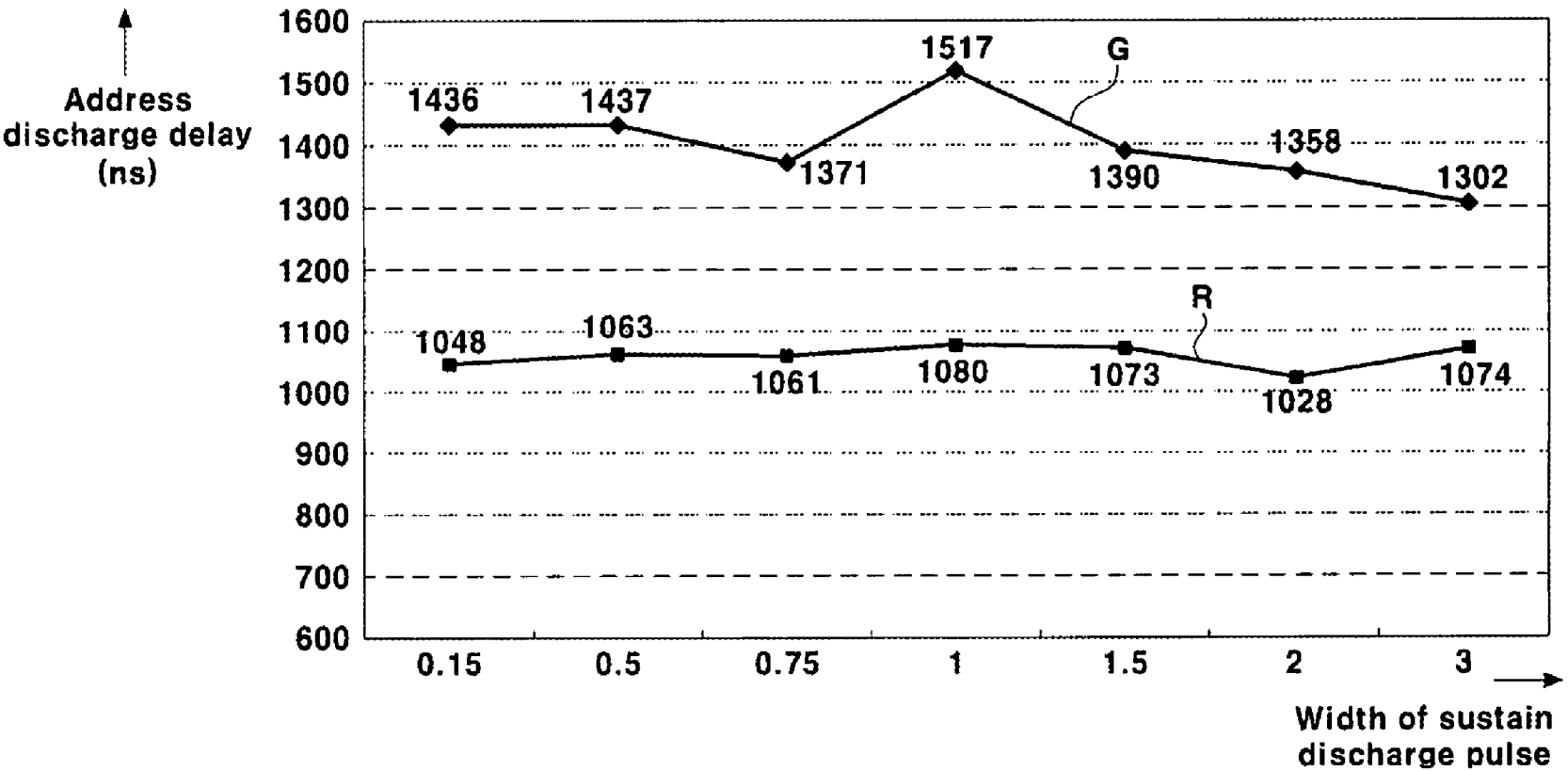
FIG. 3 illustrates a plot of a measured result of an address discharge delay according to variation of the width of a sustain discharge pulse applied to the last sustain electrode.

FIG. 3 illustrates measurements of an address discharge delay in a following subfield versus variation of the width T2 of the last sustain discharge pulse applied to the sustain electrode X. In FIG. 3, the address discharge delay in the following subfield is measured while setting the number of sustain discharge pulse to be 3 during the sustain period and changing the width T2 of the last sustain discharge pulse applied to the sustain electrode X. In addition, the width of the sustain discharge pulse applied to the scan electrode Y is set to be 1.5 μs.

As shown in FIG. 3, the address discharge delay is reduced as the width T2 of the last sustain discharge applied to the sustain electrode X is increased during the sustain period.

In particular, the width T2 of the last sustain discharge applied to a sustain electrode X in a red phosphor (R phosphor) does not appear to affect address discharge delay in a blue phosphor (B Phosphor), while an increase in the width T2 of the last sustain discharge applied to the sustain electrode X greatly affects address discharge delay in a green phosphor (G phosphor).

In particular, the address discharge delay is reduced when the width of the sustain discharge pulse is greater than 1.5 μs compared to when the width is shorter than 1.5 μs. When the width of the sustain discharge pulse is greater than 3 μs, the address discharge delay is remarkably reduced. Therefore, the width of the last sustain discharge pulse is set to be greater than 1.5 μs, in more detail, greater than 3 μs in the embodiment of the present invention. In addition, the sustain discharge with the width of greater than 1.5 μs may be applied to every subfield but the pulse is set to be applied to a subfield where less than 15 sustain discharge pulses are applied. Such a way, a length of the sustain period is reduced.

In other words, the controller 200 divides a plurality of subfields into a plurality of groups according to a total number of sustain discharge pulses for each subfield. For example, the plurality of groups may be divided into group A and group B, and each subfield is grouped in either group A or B based on whether the total number of the sustain discharge pulses of the subfield is greater that or equal to a critical value SDPc for insuring sufficient wall charges at the end thereof. For example, a subfield with equal to or less than fifteen pulses is grouped in the group A and greater than fifteen is grouped in the group B. Then the controller 200 controls the driver 400 such that the width of the last sustain discharge pulse applied to a sustain electrode X during a sustain period of the group A becomes greater than the width of other sustain discharge pulse. Such a way, the address discharge delay may be reduced, according to an exemplary embodiment of the present invention.

According to the embodiments of the present invention, the sustain discharge pulse, alternately having the voltage Vs and 0V, is applied to the scan electrode Y and the sustain electrode X with opposite polarities. However, a different sustain discharge may also be used according to another embodiment of the present invention. For example, a sustain discharge pulse, alternately having a positive voltage Vs and a negative voltage −Vs, may be applied to the scan electrode Y and the sustain electrode X while the sustain electrode X is maintained at 0V. At this time, a voltage difference between the scan electrode Y and the sustain electrode X is the same as a voltage difference when the sustain discharge pulse, alternately having the voltage Vs and 0V, is applied. In this instance, a width of the last sustain discharge pulse of −Vs applied to the scan electrode Y is extended.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A method for driving a plasma display device having a plurality of first electrodes and a plurality of second electrodes, one frame for driving the plasma display device being divided into a plurality of subfields, each subfield including a reset period, an address period, and a sustain period, the method comprising, during a sustain period of each subfield among the plurality of subfields:

alternately applying a plurality of sustain discharge pulses to the first electrode and the second electrode for triggering a sustain discharge; and setting a width of a last sustain discharge pulse applied to the second electrode, the last sustain discharge pulse applied to the second electrode having a greater width than other sustain discharge pulses applied during the sustain period of the subfield when a total number of the sustain discharge pulses applied during the sustain period of the subfield is less than a predetermined number and having a width equal to the other sustain discharge pulses when the total number of the sustain discharge pulses applied during the sustain period of the subfield is greater than or equal to the predetermined number.

2. The method as claimed in claim 1, wherein the predetermined number of sustain discharge pulses is fifteen.

3. The method as claimed in claim 1, wherein the width of the last sustain discharge pulse applied to the second electrode is greater than 1.5 μs.

4. The method as claimed in claim 1, wherein the width of the last sustain discharge pulse applied to the second electrode is greater than 3 μs.

5. The method as claimed in claim 1, wherein a last sustain discharge pulse of the sustain period of the subfield is applied to the first electrode.

6. The method as claimed in claim 5, further comprising, during a reset period immediately following the sustain period of the subfield, gradually decreasing a voltage of the first electrode after applying the last sustain discharge pulse to the first electrode during the sustain period of the subfield.

7. The method as claimed in claim 6, wherein the first electrode is a scan electrode and the second electrode is a sustain electrode.

8. A plasma display device, comprising:

a plurality of scan electrodes;

a plurality of sustain electrodes;

a controller dividing one frame into a plurality of subfields, each subfield including a reset period, an address period, and a sustain period, and grouping the plurality of subfields into a plurality of groups according to the number of sustain discharge pulses; and a driving circuit applying a sustain discharge pulse to the scan electrodes and the sustain electrodes with opposite polarities during a sustain period according to a control of the controller, wherein the controller sets a width of a last sustain discharge pulse applied during the sustain period to be greater than a width of other sustain discharge pulses during a sustain period of a first group among the plurality of groups, the first group having a total number of sustain discharge pulses applied during the sustain period less than a predetermined number, and to be equal to the other sustain discharge pulses during the sustain period of other groups.

9. The plasma display device as claimed in claim 8, wherein, in the sustain period of the first group, the last sustain discharge pulse applied to the sustain electrode is greater than 1.5 μs.

10. The plasma display device as claimed in claim 9, wherein a total number of the sustain discharge pulses applied to each subfield of the first group is less than a total number of the sustain discharge pulses applied to each subfield of a second group.

11. The plasma display device as claimed in claim 10, wherein the total number of the sustain discharge pulses applied to each subfield of the first group is less than fifteen.

12. The plasma display device as claimed in claim 8, wherein, in a reset period immediately following the sustain period, the driving circuit initializes discharge cells that have experienced a sustain discharge in the sustain period.

13. The plasma display device as claimed in claim 12, wherein the last sustain discharge pulse during the sustain period is applied to the first electrode.

14. The plasma display device as claimed in claim 9, wherein, in a reset period immediately following the sustain period, the driving circuit initializes discharge cells that have experienced a sustain discharge in the sustain period.

15. The plasma display device as claimed in claim 10, wherein, in a reset period immediately following the sustain period, the driving circuit initializes discharge cells that have experienced a sustain discharge in the sustain period.

16. The plasma device as claimed in claim 8, wherein the last sustain discharge pulse is applied to a sustain electrode.

17. A plasma display device, comprising:

a plurality of first electrodes;

a plurality of second electrodes;

a controller dividing one frame into a plurality of subfields, each subfield including a reset period, an address period, and a sustain period, and grouping the plurality of subfields into a plurality of groups according to the number of sustain discharge pulses; and a driving circuit applying a sustain discharge pulse, alternately having a positive first voltage and a negative second voltage, to the first electrodes and applying a third voltage to the second electrodes according to a control of the controller, wherein the controller sets a width of a last sustain discharge pulse applied to the first electrodes to be greater than a width of other sustain discharge pulses for selected subfields during a sustain period of a first group among the plurality of groups.

18. The plasma device as claimed in claim 17, wherein the first group has a total number of sustain discharge pulses applied during the sustain period less than a predetermined number.

19. The plasma device as claimed in claim 17, wherein the first electrode is a scan electrode and the second electrode is a sustain electrode.

* * * * *